United States Patent [19]

Cullen et al.

[11] Patent Number: 4,547,938

[45] Date of Patent: Oct. 22, 1985

[54] YARN TEXTURING JET

[75] Inventors: Robert E. Cullen, Kennett Square; Henry B. Kurowski, Chadds Ford, both of Pa.; William S. Sidwell, Port Penn, Del.

[73] Assignee: E. I. Du Pont de Nemours and Company, Wilmington, Del.

[21] Appl. No.: 668,440

[22] Filed: Nov. 5, 1984

[51] Int. Cl.[4] ..... D02G 1/16

[52] U.S. Cl. ..... 28/254; 28/272; 28/273

[58] Field of Search ..... 28/254, 272, 273

[56] References Cited

U.S. PATENT DOCUMENTS

| | | | |
|---|---|---|---|
| 3,577,614 | 5/1971 | Price . | |
| 4,259,768 | 4/1981 | Clendening, Jr. et al. | 28/272 X |
| 4,492,009 | 1/1985 | Agers et al. | 28/272 X |

*Primary Examiner*—Robert R. Mackey

[57] ABSTRACT

A self-stringing jet device which is compact and easy to string up includes a body, a yarn inlet section, and a movable venturi and a cylindrical baffle located at the outlet end of the jet. The venturi may be moved from a string up position to an operating position by engaging the movable venturi located within the jet with a rotatable cam surface actuated by an external handle that can be rotated between stops, one of which is a rotatable eccentric for adjusting the operating position of the jet.

2 Claims, 3 Drawing Figures

YARN TEXTURING JET

BACKGROUND OF THE INVENTION

The invention relates to air texturing of yarn and more particularly, to improvements in a fluid jet apparatus used to texture the yarn.

U.S. patent application Ser. No. 536,314 filed Sept. 29, 1984, now U.S. Pat. No. 4,492,009 granted Jan. 8, 1985 of common assignee, discloses a self-stringing jet device which is compact and easy to string up. The jet includes a body, a yarn inlet section, a movable venturi and a cylindrical baffle located at the outlet end of the jet. The venturi may be set to a string up position or to an operating position by means of a flat-sided rod and a ball stop engaging a groove in a collar on the venturi. In this embodiment, positive set points for string up and operating positions are provided which are not readily adjustable; removal of the jet from the texturing machine is usually required for such adjustment.

SUMMARY OF THE INVENTION

A jet device has now been found which provides positive set points for string up and operating positions which can be adjusted without removal of the jet from the texturing machine. This jet device includes a body having yarn inlet and outlet ends connected by a central bore, means for introducing pressurized gas through a gas inlet into said bore, a venturi located in said bore at the outlet end of the jet, a yarn guiding element extending into the bore from the yarn inlet end of the jet, the yarn guiding element having a passage through it for guiding yarn from the yarn inlet to the venturi, and a cylindrical baffle located at the outlet end of the jet. The venturi is axially slidable in the body from a preset operating position to a string up position back to a preset operating position and is attached to a collar having a circumferential groove therein located inside the body at the outlet end of the body. Means to positively position the venturi in optimum string up or operating position preferably is in the form of a rotatable rod positioned in mounting holes in the body, said rod having a cam surface intermediate its ends engaging said groove to positively position the venturi in the optimum string up or operating positions depending on the rotational position of said cam surface. An external handle is attached to one end of the rod and is movable between first and second stops representing string up and operating positions, respectively. The second stop preferably is a rotatable disc eccentrically mounted to the body of the jet and readily adjustable to provide a range of settings for the operating position.

DETAILED DESCRIPTION OF THE PREFERRED EMBODIMENT

Figure 1:
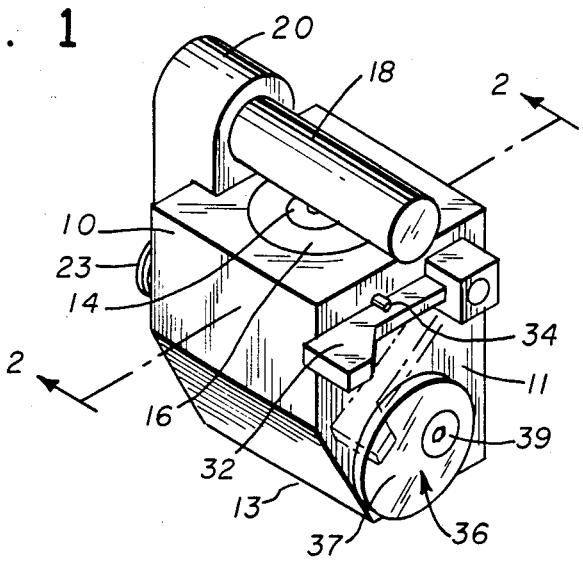
FIG. 1 is a perspective view of a preferred embodiment of the invention.

Referring to the drawing, the major elements of the jet device are body 10, yarn guiding element 12, movable venturi 14 with its attached collar 16 and baffle 18 with its supporting bracket 20 attached to body 10. Yarn guiding element 12 is press fitted into body 10 at the inlet end of the jet and consists of an entrance 13 in communication with the yarn exit orifice 15 of the yarn guiding element. The outer portion of the yarn guiding element comprises a cylindrical portion 17 with a conical tip 19. Fluid orifice 22 located in flange 21 on yarn guiding element 12 has its axis parallel to the axis of yarn guiding element 12 and is supplied with fluid such as compressed air through fluid connection 23. Venturi 14 is free to move axially within the body 10 and a seal is formed between the venturi and body by O-ring seal 24 seated in an annulus 25 in the body. The venturi 14 is press fitted into collar 16 and collar 16 is free to move within the recess 26 at the outlet end of the jet body. A circumferential groove 28 is formed in collar 16. A rod 30 extends through body 10 and engages groove 28. The rod is rotatable in both the body and the groove. A handle 32 is attached to the end of the rod so that the rod may be easily rotated. The rod is not completely circular but has a cam surface 31 intermediate its ends which is coincident with the groove 28. First and second stops 34, 36, respectively, on the surface 11 of the body 10 restrict the movement of handle 32 and consequently the movement of venturi 14. The first stop 34 is a set screw extending above surface 11 of body 10 and the second stop 36 is a disc 37 eccentrically mounted to the surface 11 by a screw 39 which may be tightened to lock the disc in place.

The following procedure is used to set the optimum string up and operating procedures for the jet. Air pressure (approximately 140 psig) is applied to the jet through connection 23. With the collar 16 held in a fixed location within recess 26 by rod 30 (FIG. 2), the venturi is forced (using a machine press not shown) within the fixed collar towards the conical tip 19 of yarn guiding element 12 until the maximum amount of air is aspirating through yarn inlet 13. The collar is then fixed to the venturi via the set screw 40. Next the rod is rotated until handle 32 contacts disc 37 so that the cam surface 31 is in the position shown in FIG. 3. This allows the collar 16 to move toward the outlet end of the jet under the force of the air pressure carrying with it venturi 14. The movement of collar 16 toward the outlet is defined by the cam surface 31. When the cam surface is spaced from the walls of groove 28 the air pressure forces the collar and venturi outward away from the yarn guiding element 12 a distance determined by the setting of disc 37 and the disc 37 is adjusted until the best operating point is reached for the jet. This is determined by the most stable delivery of yarn at the exit end of the jet or by maximizing the wind up tension of the yarn after it leaves the jet. The disc 37 is then fixed in place by tightening screw 39.

Figure 2:
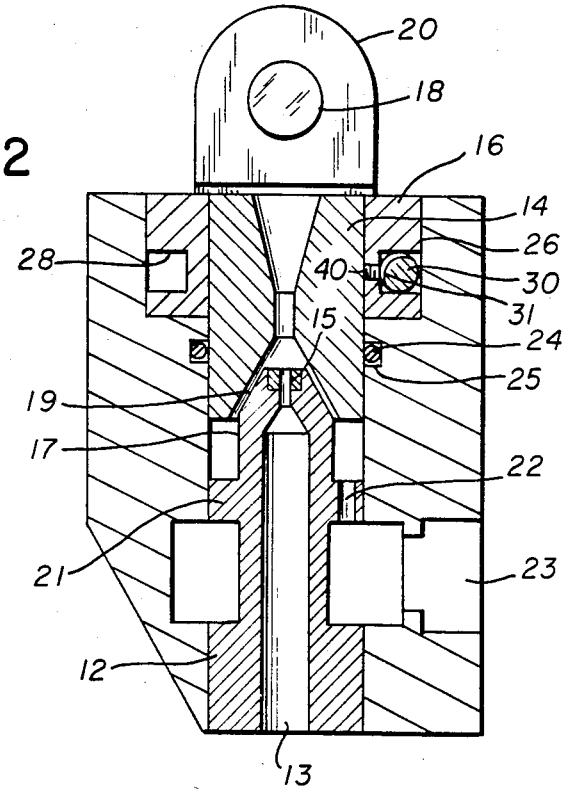
FIG. 2 is an enlarged section view of FIG. 1 taken along line 2—2 showing the jet in string up position.
Figure 3:
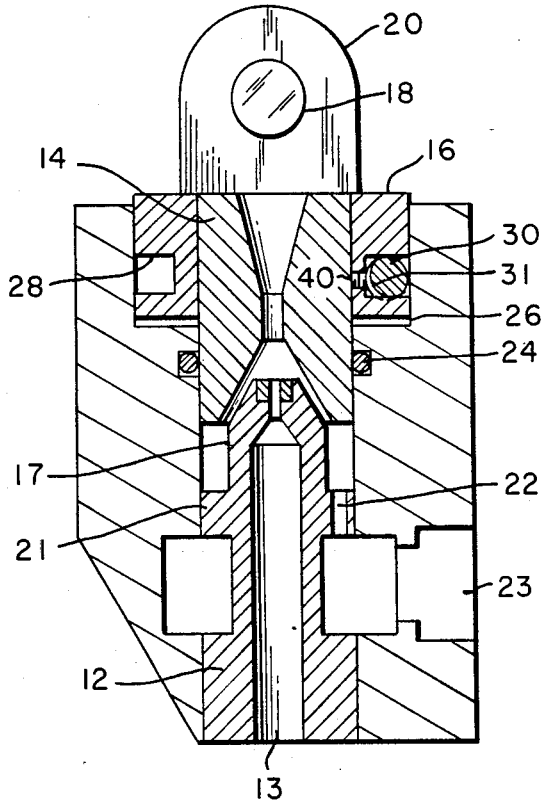
FIG. 3 is an enlarged section view of FIG. 1 taken along line 2—2 showing the jet in operating position.

The operation of this device is as follows: when a yarn or yarns are to be strung up, rod 30 is turned by handle 32 to a position shown in FIG. 2, (i.e., handle 32 is against stop 34, FIG. 1) so that movable venturi 14 is moved toward conical tip 19 thus restricting the flow of air until ambient air is aspirated through yarn inlet 13 into and through movable venturi 14. The operator then inserts yarn into the inlet 13 where the aspirated air assists in carrying the yarn through the venturi to the outlet end. The operator then rotates rod 30 to the position shown in FIG. 3, (i.e., handle 32 is against disc 37, FIG. 1) so that the movable venturi 14 is allowed to move away from conical tip 19 under the force of the air pressure within the jet until it reaches the optimum operating setting established by the orientation of disc 37.

We claim:

1. In a yarn texturing jet including a body having yarn inlet and outlet ends connected by a central bore, means for introducing pressurized gas through a gas inlet into said bore, a venturi located in said bore at said outlet end, said venturi having a collar attached thereto, said collar having a circumferential groove and being axially slidable in said body from a preset operating position to a string up position back to a preset operating position, a yarn guiding element extending into said bore from the yarn inlet end of the body, said yarn guiding element having a passage therethrough for guiding yarn from the yarn inlet to the venturi and a cylindrical baffle attached to a bracket located adjacent the outlet end of the jet, the improvement comprising: a rod rotatably mounted in the body, said rod having a cam surface intermediate its ends, said cam surface engaging said groove; a handle attached to one end of the rod and movable adjacent to a surface of said body; and first and second stops located on said surface between which said handle is rotated to string up and operating positions, respectively, said second stop being adjustable to provide a range of settings for the operating position.

2. The yarn texturing jet as defined in claim 1, said second stop being a rotatable disc eccentrically mounted to said surface.

* * * * *